US009322622B2

(12) United States Patent
Frank et al.

(10) Patent No.: US 9,322,622 B2
(45) Date of Patent: Apr. 26, 2016

(54) SHOTSHELL WITH COMBINATION SLUG AND SHOT LOAD

(75) Inventors: Ben N. Frank, Worden, IL (US); Morris C. Buenemann, Jr., Florissant, MO (US)

(73) Assignee: OLIN CORPORATION, St. Louis, MO (US)

( * ) Notice: Subject to any disclaimer, the term of this patent is extended or adjusted under 35 U.S.C. 154(b) by 847 days.

(21) Appl. No.: 13/005,586

(22) Filed: Jan. 13, 2011

(65) Prior Publication Data

US 2011/0174186 A1 Jul. 21, 2011

Related U.S. Application Data

(60) Provisional application No. 61/295,366, filed on Jan. 15, 2010.

(51) Int. Cl.

| | |
|---|---|
| ***F42B 7/02*** | (2006.01) |
| ***F42B 5/03*** | (2006.01) |
| ***F42B 7/04*** | (2006.01) |
| ***F42B 7/10*** | (2006.01) |

(52) U.S. Cl.
CPC ... *F42B 5/03* (2013.01); *F42B 7/04* (2013.01); *F42B 7/10* (2013.01)

(58) Field of Classification Search
CPC ..... F42B 5/03; F42B 7/04; F42B 7/10
USPC ..... 102/460
See application file for complete search history.

(56) References Cited

U.S. PATENT DOCUMENTS

| | | | | | |
|---|---|---|---|---|---|
| 1,583,559 | A | * | 5/1926 | Kenneweg | 102/460 |
| 3,405,638 | A | * | 10/1968 | Stoner, Jr. | 102/449 |
| 3,598,057 | A | | 8/1971 | Potter | 102/91 |
| 3,796,157 | A | | 3/1974 | Anderson | 102/42 C |
| 3,996,865 | A | | 12/1976 | Dwyer | 47/1 R |
| 4,006,688 | A | * | 2/1977 | Craft et al. | 102/457 |
| 4,506,605 | A | | 3/1985 | Maki | 102/457 |
| 4,635,555 | A | | 1/1987 | Ferri | 102/453 |
| 4,664,034 | A | | 5/1987 | Christian | 102/457 |
| 4,759,885 | A | * | 7/1988 | Kurtz | 264/3.1 |
| 4,805,535 | A | * | 2/1989 | Marcon | 102/503 |
| 4,815,388 | A | * | 3/1989 | Schluckebier et al. | 102/449 |
| 4,823,702 | A | * | 4/1989 | Woolsey | 102/502 |
| 4,829,904 | A | * | 5/1989 | Sullivan | 102/439 |
| 4,864,935 | A | | 9/1989 | Schlegel et al. | 102/438 |
| 4,913,054 | A | * | 4/1990 | Petersen | 102/439 |
| 4,949,644 | A | | 8/1990 | Brown | 102/498 |
| 4,982,666 | A | * | 1/1991 | Wohler | 102/439 |
| 4,996,923 | A | | 3/1991 | Theising | 102/438 |
| 4,996,924 | A | | 3/1991 | McClain | 102/501 |
| 5,150,909 | A | * | 9/1992 | Fitzwater | 473/569 |
| 5,325,786 | A | | 7/1994 | Petrovich | 102/438 |
| 5,413,050 | A | | 5/1995 | Maki | 102/457 |
| 5,429,054 | A | * | 7/1995 | Topping | 102/458 |
| 5,454,325 | A | * | 10/1995 | LeBlanc | 102/506 |
| 6,367,388 | B1 | * | 4/2002 | Billings | 102/454 |
| 6,415,719 | B1 | | 7/2002 | Buccelli et al. | 102/457 |
| 6,539,873 | B2 | | 4/2003 | Diller | 102/458 |

(Continued)

*Primary Examiner* — Michelle R Clement
(74) *Attorney, Agent, or Firm* — Harness, Dickey & Pierce, P.L.C.

(57) ABSTRACT

An improved shotshell of the type having a hull, having a propellant, a wad, and a load. The improvement comprises the load comprising of at least one non-spherical slug and shot, with at least one shot disposed in front of the slug in the hull.

15 Claims, 6 Drawing Sheets

(56) References Cited

U.S. PATENT DOCUMENTS

| | | | | |
|---|---|---|---|---|
| 6,899,034 | B1 | 5/2005 | Glover et al. | 102/457 |
| 7,025,001 | B2 | 4/2006 | Brunn | 102/502 |
| 7,174,833 | B2 * | 2/2007 | Diller | 102/458 |
| 7,228,801 | B2 * | 6/2007 | Dunnam et al. | 102/458 |
| 7,243,603 | B2 | 7/2007 | Sheaffer | 102/449 |
| 7,299,733 | B2 * | 11/2007 | Eberhart et al. | 86/55 |
| 7,357,082 | B1 | 4/2008 | Racho | 102/439 |
| 7,487,727 | B2 * | 2/2009 | Eberhart et al. | 102/510 |
| 7,530,315 | B2 * | 5/2009 | Tepera et al. | 102/393 |
| 7,607,393 | B2 * | 10/2009 | Menefee | 102/502 |
| 7,610,857 | B1 * | 11/2009 | Dunnam et al. | 102/458 |
| 7,690,310 | B2 * | 4/2010 | Engel et al. | 102/452 |
| 7,765,933 | B2 * | 8/2010 | Poore et al. | 102/460 |
| 2006/0169165 | A1 | 8/2006 | Brunn | 102/502 |
| 2007/0012212 | A1 | 1/2007 | Sheaffer | 102/457 |
| 2007/0012213 | A1 | 1/2007 | Sheaffer | 102/457 |
| 2007/0119523 | A1 | 5/2007 | Amick | 148/540 |

* cited by examiner

SHOTSHELL WITH COMBINATION SLUG AND SHOT LOAD

CROSS-REFERENCE TO RELATED APPLICATIONS

This application claims the benefit of U.S. Provisional Application No. 61/295,366, filed on Jan. 15, 2010. The entire disclosure of the above application is incorporated herein by reference.

FIELD

The present disclosure relates to shotshells, and in particular, to a shotshell with a combined load of at least one slug and shot.

BACKGROUND

The statements in this section merely provide background information related to the present disclosure and may not constitute prior art.

Shotshells conventionally include a hull or shell containing propellant, a wad, and a load. Typically, the load is a plurality of shot or pellets. Shotshells have also been made with a single slug. This allows a shooter to fire a large, single projectile from a shotgun. More recently, shotshells have been made with sabots which improve performance of slugs from shotguns. Shot is desirable because the dispersion of multiple projectiles allows for more aim error, particularly for moving targets. A slug is desirable for deep penetration and large energy deposit on a target. Shot is desirable because it is easier to get at least some shot on the target, causing some damage; slugs are desirable because they can cause significant damage to the target.

SUMMARY

Generally, embodiments of this invention provide an improved shotshell that includes a combined load of at least one slug and shot. The shot are preferably disposed in front of the slug so that the slug facilitates dispersing the shot. The inventors have found that this configuration is particularly useful in personal defensive rounds. The slug provides a high impact projectile for a primary target. The shot provides projectiles with wider dispersion for greater probability to hit the intended target when point of aim is less than ideal.

Further areas of applicability will become apparent from the description provided herein. It should be understood that the description and specific examples are intended for purposes of illustration only and are not intended to limit the scope of the present

DRAWINGS

The drawings described herein are for illustration purposes only and are not intended to limit the scope of the present disclosure in any way.

DETAILED DESCRIPTION

Figure 1:
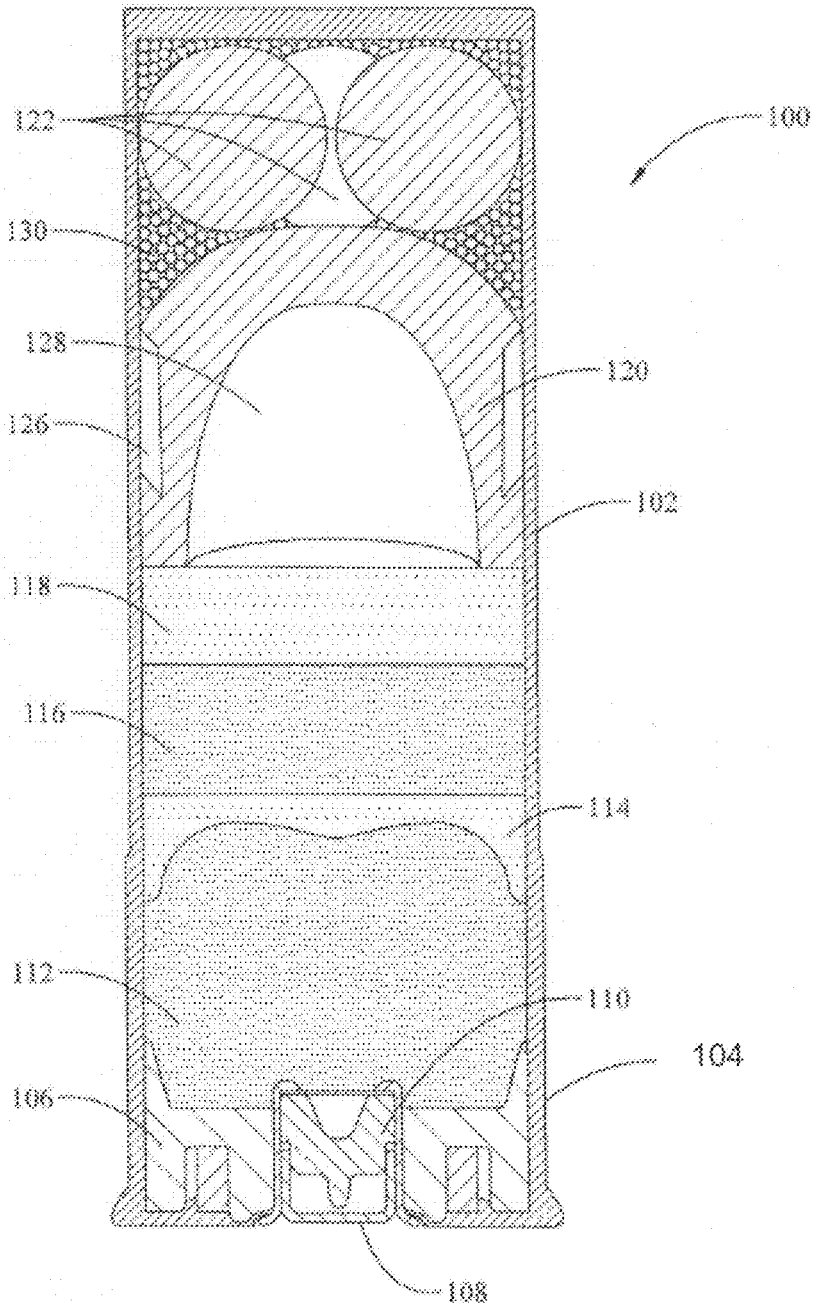
FIG. 1 is a longitudinal cross-sectional view of a first preferred embodiment of a shotshell, in accordance with the principles of this invention.
Figure 1A:
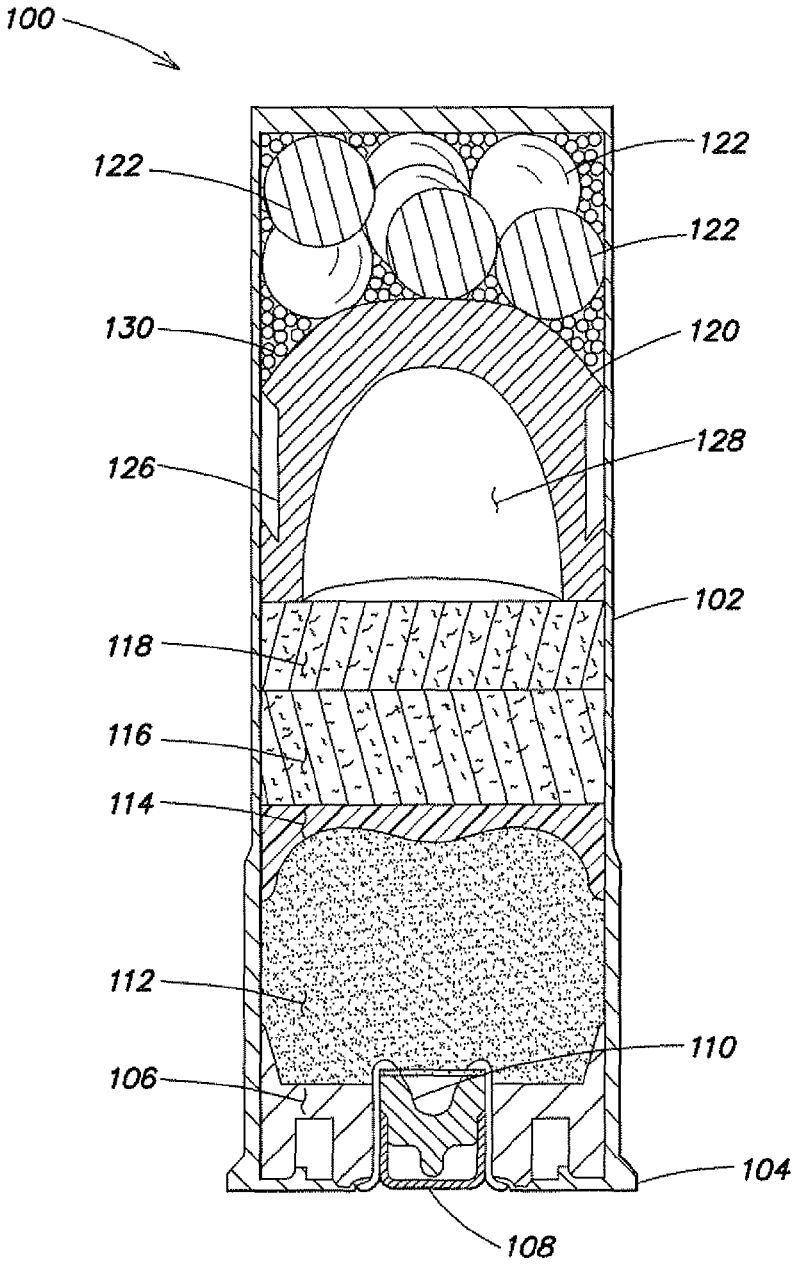
FIG. 1A is a longitudinal cross-sectional view of an alternative construction of the first preferred embodiment, with fourteen shot in front of the slug.
Figure 1B:
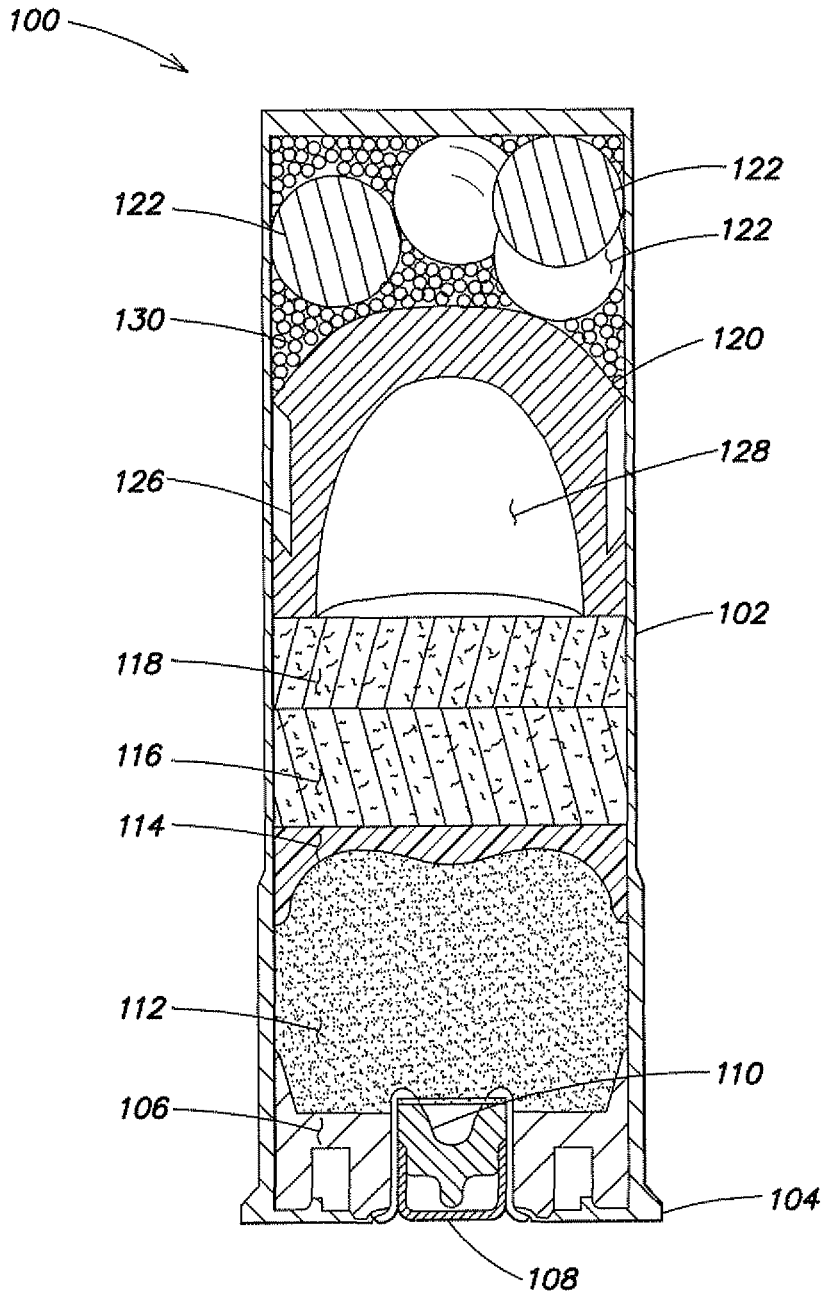
FIG. 1B is a longitudinal cross-sectional view of an alternative construction of the first preferred embodiment, with six shot in front of the slug.

The following description is merely exemplary in nature and is not intended to limit the present disclosure, application, or uses. It should be understood, that throughout the drawings, corresponding reference numerals indicate like or corresponding parts and features.

A first preferred embodiment of shotshell, in accordance with the principles of this invention is indicated generally as 100 in FIG. 1. The shotshell 100 comprises a casing or hull 102 with a metal head 104. A base wad 106 is disposed in the bottom of the metal head 104. A primer 108, seated in an anvil 110 is disposed in the base wad 106 and projects through the end of the metal head 104. A charge of propellant 112 is located in the base of the shotshell 100, adjacent the primer 108 and anvil 110. A plastic cup wad 114 is disposed inside the hull 102, adjacent the propellant 112. A fiber wad 116 and a card wad 118 are disposed in front of the plastic cup wad 114.

A load is disposed in the hull 102 in front of the wads 114, 116, and 118. In accordance with this third preferred embodiment, the load comprises a slug 120 and three #00 buckshot 122 in front of the slug. The slug 120 is preferably a one ounce slug, with a deep hollow 124 and having externally rifling 126. There is buffering 130, such as grex, surrounding the buckshot 122 to help the buckshot retain their shape upon firing. The slug 120 and shot 122 are preferably made of lead or lead alloy, but they could be made of other suitable metal or other material.

Figure 2:
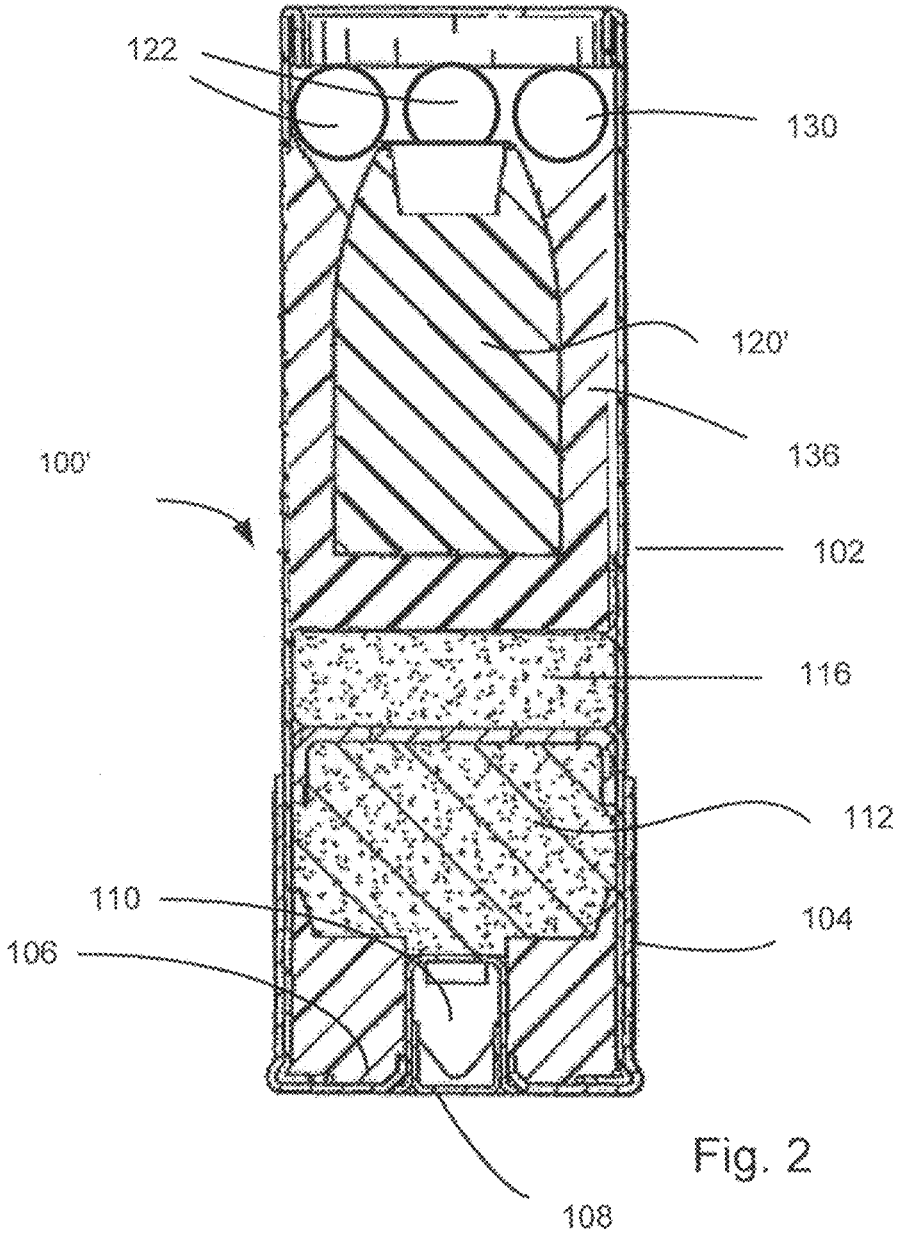
FIG. 2 is a longitudinal cross-sectional view of a second preferred embodiment of a shotshell, in accordance with the principles of this invention.
Figure 3:
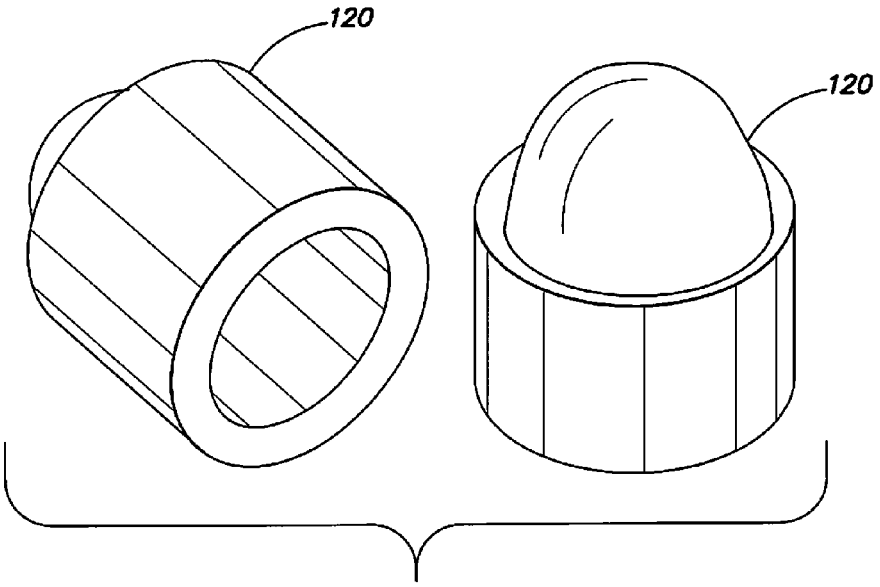
FIG. 3 is a perspective view of a Foster-type slug that can be used in some embodiments of this invention.

The slug 120 can be a full bore slug, for example, a Foster slug (FIG. 3) with heavy external rifling and a deep hollow in its heel or rear end, so that the center of mass is located forward of the center of the slug. The slug 120 can alternatively be some other type of slug, including solid slugs, finned slugs, and slugs with attached wads. As shown in FIG. 2 in another preferred embodiment, the shotshell 100' is similar in construction to shotshell 100, and corresponding slug can be a sub-caliber slug 120', disposed in a sabot 136. The slugs 120 or 120' are sized for their gauge and intended use. In a typical 12 gauge shell, for example, the slug 120 might weigh about 1 ounce, but could weigh about 0.75 of an ounce or about 0.875 of an ounce, depending upon the desired maximum load, and the size of the other components of the load. In some circumstances, it may be desirable to keep the total load less than 1.125 ounces, or even less than about 1 ounce. The sub-caliber slug 120' might weigh 0.8 ounces or less.

Also in accordance with the principles of this invention, at least one shot or pellet 122, and preferably, a plurality of shot or pellets are disposed in the hull 102 as well. The shot can be conventional lead or lead alloy shot. Alternatively, the shot 122 can be non-lead metal, ceramic, or other material, such as tin, tin alloys, tungsten or tungsten alloys. The size of the shot is likewise selected for the gauge of the shell and intended use. In a twelve gauge shell, for example, three #00 buckshot fit in the shell on front of the slug 120 or 120'. While the use of smaller sizes of shot allows more shot to fit in a given size shell, larger shot are generally preferred because they are more effective projectiles.

Whatever the materials of construction, the slug 120 or 120' preferably constitutes at least 50% of the total weight of the load, and more preferably, at least 70% of the total weight of the load.

The shot 122 are preferably disposed in front of the slug 120 or 120' in the hull 102, but the shot could be located behind the slug, or shot can be disposed both in front of and behind the slug. When the shot is in front of the slug 120 or 120', the slug helps to disperse the shot so that the shot covers a broader area.

Grex filler or other filling material can be provided around the projectiles in the shell to protect the projectiles and help them retain their shape as they pass through the bore of the gun upon firing of the shell.

Example 1

In one preferred embodiment, there is one slug 120 or 120', and there are at least three pellets of #00 buckshot in the hull 102, disposed in front of the slug.

Example 2

In another preferred embodiment, there is one slug 120 or 120', and there are at least 14 pellets of #3 buckshot in the hull 102, disposed in front of the slug.

Example 3

In another preferred embodiment, there is one slug 120 or 120', and there are at least 6 pellets of #1 buckshot in the hull 102, disposed in front of the slug.

Example 4

In another preferred embodiment, there is at least one slug, and there are at least 6 pellets of #1 buckshot in the hull 102, disposed behind the slug.

Figure 4:
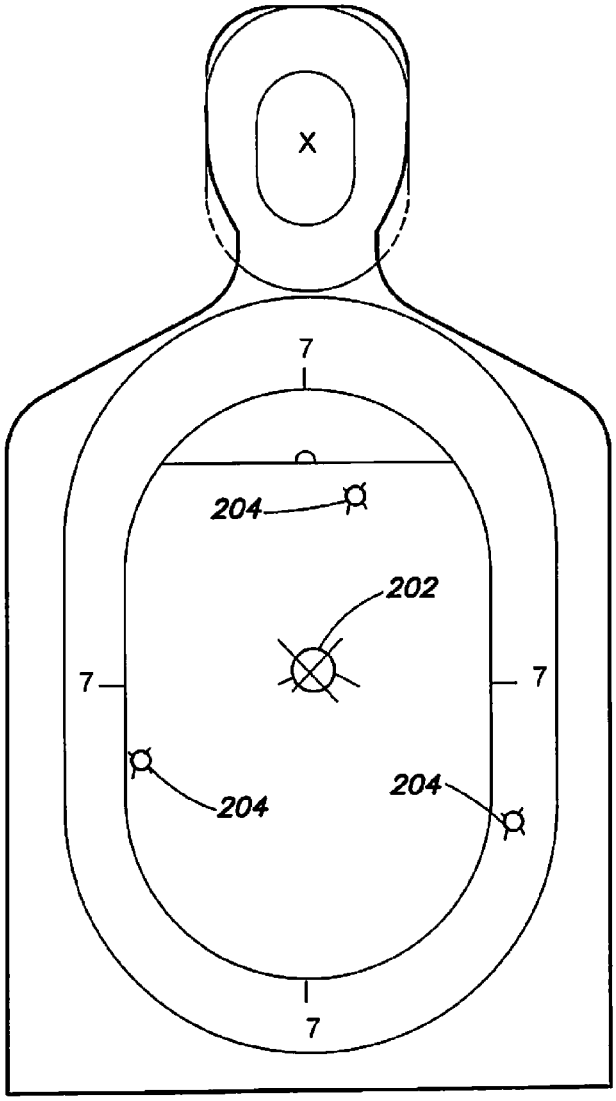
FIG. 4 is a diagram showing a typical pattern of a shell of the preferred embodiment.

FIG. 4 shows the pattern resulting from the firing of a shell constructed according to the principles of the first embodiment. As shown in FIG. 4, at a distance of 15 yards, the slug makes mark 202 in the center of the pattern, and marks 204 for the three pellets of buckshot are roughly equally spaced from the center of the pattern and roughly equally spaced at approximately 120° from each other.

What is claimed is:

1. An improved shotshell of the type having a hull, a head, propellant disposed in the hull, a wad disposed in the hull in front of the propellant, and a load disposed in the hull in front of the wad, the improvement comprising the load consisting of at least one non-spherical slug and at least one generally spherical shot disposed in the hull in front of the slug.

2. The improved shotshell of claim 1, wherein the slug is a Foster-type slug, having a forward end and a rear end, with a deep hollow in its rear end, and a center of mass near the forward end.

3. The improved shotshell of claim 1, wherein the slug is a full bore slug.

4. The improved shotshell of claim 1, wherein there is one slug which comprises at least 50% of the total weight of the load.

5. The improved shotshell of claim 4, wherein the slug constitutes at least 70% of the total weight of the load.

6. The improved shotshell of claim 1, wherein there is one slug of about 436 grains (1 ounce).

7. The improved shotshell of claim 1, wherein there are at least three generally spherical shot disposed in the hull in front of the slug.

8. The improved shotshell of claim 1, wherein the shot are #00 buckshot.

9. The improved shotshell of claim 1, wherein there is one slug, disposed in a sabot in the hull.

10. The improved shotshell of claim 1, wherein there is one rifled slug in the hull.

11. The improved shotshell of claim 1, wherein there is one slug, and wherein there are at least three generally spherical #00 buckshot in front of the slug.

12. The improved shotshell of claim 1, wherein there is one slug with 14 generally spherical #3 buckshot in the hull in front of the slug.

13. The improved shotshell of claim 1, wherein there is one slug with 6 generally spherical #1 buckshot in the hull in front of the slug.

14. The improved shotshell of claim 1, wherein the weight of the entire load is less than about 1.125 ounces.

15. The improved shotshell of claim 1, wherein the weight of the entire load is less than about 1 ounce.

* * * * *